US007300329B2

(12) United States Patent
Cohen

(10) Patent No.: US 7,300,329 B2
(45) Date of Patent: Nov. 27, 2007

(54) SYMMETRIC POI

(76) Inventor: Shahar Cohen, 4 Hashala St., Tel Aviv (IL)

( * ) Notice: Subject to any disclaimer, the term of this patent is extended or adjusted under 35 U.S.C. 154(b) by 35 days.

(21) Appl. No.: 11/284,887

(22) Filed: Nov. 23, 2005

(65) Prior Publication Data

US 2006/0084512 A1 Apr. 20, 2006

Related U.S. Application Data

(63) Continuation-in-part of application No. 10/856,789, filed on Jun. 1, 2004, now abandoned.

(51) Int. Cl.
*A63H 33/18* (2006.01)

(52) U.S. Cl. ..... 446/490; 446/247; 273/109

(58) Field of Classification Search ..... 446/175, 446/215, 242, 247, 252, 489, 397, 490, 369; 273/109
See application file for complete search history.

(56) References Cited

U.S. PATENT DOCUMENTS

| | | | | |
|---|---|---|---|---|
| 672,099 | A | 4/1901 | Jackson | |
| 4,784,391 | A | 11/1988 | Herron | |
| 4,878,868 | A | 11/1989 | Shaw | |
| 6,092,489 | A | 7/2000 | Huettner et al. | |
| 6,109,196 | A * | 8/2000 | Silber | 112/475.08 |
| 6,629,873 | B2 | 10/2003 | Shaw | |
| 6,652,345 | B1 * | 11/2003 | Lin | 446/15 |
| 6,896,578 | B2 | 5/2005 | Shaw | |
| 2004/0116040 | A1 | 6/2004 | Mulvihill et al. | |

* cited by examiner

*Primary Examiner*—Kien Nguyen
(74) *Attorney, Agent, or Firm*—Mark M. Friedman

(57) ABSTRACT

A symmetrical poi to be used by jugglers to safely perform moves includes a flexible long strap and two weights disposed at each end of the flexible long strap having reversibly deformable soft structure and having dimensions that fit in a human hand for easy grasping, easy releasing and easy catching, wherein the length of said strap and the weights mass is suitable for performing a wide variety of new moves.

21 Claims, 17 Drawing Sheets

SYMMETRIC POI

REFERENCE TO CROSS-RELATED APPLICATION

This application is a Continuation-in-Part of U.S. application Ser. No. 10/856,789 filed Jun. 1, 2004 now abandoned.

FIELD AND BACKGROUND OF THE INVENTION

The present invention relates to a juggling tool and, in particular, to a swinging symmetrical poi configuration.

A symmetrical poi is a juggling apparatus that enables performance of various types of juggling moves, possibly the highest number of moves for a single juggling apparatus.

Currently the poi is used as a juggling apparatus in many countries around the globe.

A typical poi is made up of a cable, a wire, a chain, or a cord, connecting one end to a weight and the other end to a handle. By oscillating the hand holding the handle, the weight can be swung in a simple motion in one plane of rotation or in complex changing motions, causing intriguing effects. Adding lights, fire or colorful strips to the weight can create a more fascinating visual effect.

It is common to use a pair of poi, one in each hand, to perform combinations of maneuvers.

The combination of simple structure, visually pleasing performance and enjoyable athletic activity makes the use of the poi popular among professional and amateur jugglers.

The origin of the poi is presumed to be in New Zealand. Poi is a Maori, (native New Zealand language) word for a ball on a string. Poi is both singular and plural.

The first use of the poi, as a simple stone tied to a rope, was as a weapon. Over the time the poi was refined and was also used for fun, ceremonies, dancing, and as a means to develop coordination and athletic abilities.

The evolution of means of warfare to sports, games, toys, and juggling apparatus is a well-known phenomenon, for example, in fencing, nunchaku, javelin throwing, and hammer throwing.

Weapons based on one or more weights connected to a cable, (or wire, chain, cord, string, etc.) which can accumulate energy by revolutions with hand force, were developed in many places in ancient times. Among these weapons are, for example, the Japanese "Ninja Chain", a long chain, about one meter long, with one weight at each end, the Scottish "Bashing Ball"—a swinging weapon of a heavy ball at one end of a chain, and the South American "Hunting Weapon", made of four stones at each end of two cords, the cords being tied together at the centers.

The motion of one weight attached to the end of a flexible long strap that is held on the other end and accelerated by rotational movement, for a short time after release from the hand, has a linear ballistic nature. The weight moves forward and the flexible strap drags behind, waving in the air vortex caused by the weight. The trajectory of the moving weight is affected, among other factors, by the gravitational and aerodynamic forces (for movement within the atmosphere of Earth).

If an essentially identical weight is connected to the other end of the flexible strap, and grasped by the rotating hand, then the motion of the two weights attached to the strap's center of gravity is similar to the previous motion, but the two weights have a rotational motion around that center of gravity.

Various forms of two swinging weights connected to a long string are known in the art.

U.S. Pat. No. 672,099, to Jackson, of 1901, the contents of which are hereby incorporated by reference, teaches the operation of a toy comprising a ring adapted to be placed upon one of the fingers of a hand, the ring being provided at one side with an eyelet and a cord passed through the eyelet and provided at each end with a ball. In the operation of the device the ring is placed on one of the fingers of a hand and one of the balls is thrown of the hand from an operator and the other ball is drawn into the palm of the hand.

U.S. Pat. No. 4,878,868, U.S. Pat. No. RE34,208, and U.S. Pat. No. 6,629,873, all to Shaw, the contents of which are hereby incorporated by reference, teach a swinging of a weight connected to a long string based on a rigid material structure of the weights, with a third weight with a hole that can slide along the string.

In spite of the teaching of U.S. Pat. No. 4,878,868 that the weights can be made of an edible material or chewing gum, and in spite of the teaching of U.S. Pat. No. 6,629,873 that the weights can be made of material surrounding the weight that is a soft foam and the weight can be made with a material of non-homogeneous density, each of those weights is a single rigid body all of whose components are connected to each other with no free movement among them, excepting plastic or elastic movement.

As used herein the specifications and claims, the term flexible long strap refers to a flat long piece of a flexible material that can easily bent, with the ability to resist to a tension force, absent of elastic ability.

As used herein the specifications and claims, the term soft structure refers to a material having qualities that permit yielding to physical human palm force and permit human fingers to sink in easily.

As used herein the specifications and claims, the term poi refers to a weight connected to one end of a flexible long connector that enables swinging it around the body in various ways by grasping the other end of the connector and moving it with proper movements, serving as a juggling apparatus.

The poi can have a handle at the other end of the connector. Its dimensions and mass configurations are adjusted to the juggler's body size, to assure the ability of performing simple and complex rotational moves around the human body or in proximity to the juggler. These characteristics distinguish the poi from small weights and string hand toys.

The poi weight can contain and carry a variety of means, such as light, fire, strips, or a whistle in order to increase the visual and sound effects of the performance. The visual and sound effects of the performance can be dependent on the symmetrical poi rotational direction, such that when the juggler changes the rotational direction the means change the emitted colored light to another color, a color of another wavelength, or change the emitted sound to another sound, a sound of another wavelength.

A juggler can do moves with one, two, or more poi at the same time.

The absence of a second weight on the poi is a disadvantage. After releasing the poi from the juggler's hand, the poi's nature of motion is the same as any other weight attached to a flexible long connector, and having been accelerated by rotational movement. Because of that nature of motion many movements can not be performed with an asymmetrical poi, such as the throwing of a poi into the air by one juggler and continuation of the rotational movement by a second juggler, or starting the rotation of a poi by one of a juggler's hands in a horizontal course above his head, and after the weight achieves high speed, sliding the juggler's hand along the flexible connector to a point close to the strap center, adding his second hand and maintaining the rotational movement in a similar manner to that of a rigid stick.

Additional another advantage of the symmetrical poi is the using of it as a tool for the improvement of coordination and aerobic and other abilities There is therefore a need for and it would be highly advantageous to have a symmetrical poi for safely performing a wide variety of new juggling moves, and improving the performance of current poi juggling moves.

SUMMARY OF THE INVENTION

It is an object of the present invention to provide safe-swinging symmetrical poi configurations having two weights disposed at both ends of a flexible long strap with a rotational motion characteristic.

The symmetrical poi enables performance of new and unique juggling moves, as well as performance of juggling moves previously known from common juggling apparatus such as poi, nunchaku, and staf (juggling stick).

All references to spatial form, form in two-dimensional view, and form section herein the specifications and claims, is always with regard to the natural alignment of the symmetrical poi configuration, as it would be in resting position along a straight axis in a gravity-free space, other than certain cases in which the description refers to other configurations that the symmetrical poi attains as a result of the forces exerted upon it.

Unless otherwise defined, all technical and scientific terms used herein have the same meaning as commonly understood by one of ordinary skill in the art to which this invention belongs. The materials, methods, and examples provided herein are illustrative only and not intended to be limiting.

According to the present invention there is provided a symmetrical poi, for enabling the performance of safe juggling moves such as moves around a juggler's body or around a part of a juggler's body, or close to a juggler's body, or by throwing into the air, or throwing into the air and catching, by one juggler or by more than one juggler, the symmetrical poi including: (a) a flexible long strap, wherein the dynamic friction coefficient between the flexible long strap and the skin of the juggler is at least 0.4, and wherein the length of the flexible long strap is at least 40 centimeters and is at most 120 centimeters; (b) a first weight disposed at one end of the flexible long strap, the first weight having a reversibly deformable soft structure and having dimensions that fit in a human hand for easy grasping, easy releasing and easy catching, having a cross-section that is substantially identical to the cross-section of the flexible long strap in the contact area with the flexible long strap, and wherein the first weight has cross-section areas that change gradually, forming a tangential three dimensional shape with the flexible long strap; and (c) second weight disposed at the second end of the flexible long strap having a substantially identical mass to the first weight, having a reversibly deformable soft structure having dimensions that fit in a human hand for easy grasping, easy releasing and easy catching.

According to still further features in the described preferred embodiments the flexible long strap has a cross section inscribed in an imaginary rectangle, wherein the length of one side of the imaginary rectangle is at least 4 times larger than the dimension of the second side of the imaginary rectangle, and wherein the dimension of the one side of the imaginary rectangle is at least 8 millimeters and is most 35 millimeters.

According to still further features in the described preferred embodiments the width of the first weight at its widest part is at least 30 millimeters and is at most 80 millimeters, and the width of the first weight at its widest part is at least 1.3 times larger, and at most 2.2 times larger then the dimension of the flexible long strap at its widest part.

According to still further features in the described preferred embodiments each of the first weight and the second weight includes: (i) a bag; and (ii) grains filling the bag; wherein in case of any collision of the first weight with the second weight would be a plastic collision, and wherein said symmetrical poi can be grasped by pinching said weight between two fingers.

According to still further features in the described preferred embodiments the grain filling type is selected from a group consisting of rice grains, wheat grains, sorghum grains, and cotton grains or a combination of two or more types of grains.

According to still further features in the described preferred embodiments each of the first weight and the second weight includes: (i) a bag; and (ii) weight filling the bag, wherein the weight filling type is selected from a group consisting of liquid or powder.

According to still further features in the described preferred embodiments the symmetrical poi further including: (d) means for increasing the visual effect of the performance.

According to still further features in the described preferred embodiments the means for increasing the visual effect is selected from a group consisting of decoration strips, phosphorous glowing paint, light sources, flashlights, fire torches, powder dispersals, or smoke dispersals.

According to still further features in the described preferred embodiments the light source for increasing the visual effect, emits colored light in which the light color is dependent on the symmetrical poi's rotational direction.

According to still further features in the described preferred embodiments the symmetrical poi further including: (e) means for increasing the sound effect of the performance.

According to still further features in the described preferred embodiments the first weight has a mass at least ten times larger than the flexible long strap's mass.

According to still further features in the described preferred embodiments each of said first weight and said second weight has a shape that conforms to the human hand.

According to still further features in the described preferred embodiments, each of the first weight and the second weight have holes; wherein the size and shape of the hole is suitable for performance of rotation of the symmetrical poi around a finger stuck in the hole; and wherein the hole does not subtract from the sense of continuity of a closed hand sliding over said symmetrical poi.

According to another embodiment of the invention the a poi for safely performing a wide variety of juggling moves, the poi including: (a) a flexible long strap wherein the length of the strap is at least 40 centimeters, for enabling the performance of juggling moves such as moves around a juggler's body or around a part of a juggler's body, or close to a juggler's body, or by throwing into the air, or throwing into the air and catching, by one juggler or by more than one juggler; (b) a first weight disposed at one end of the flexible long strap having a reversibly deformable soft structure and having dimensions that fit in a human hand for easy grasping, easy releasing and easy catching; and (c) a second weight disposed at the second end of the flexible long strap having a mass of at least one third of the first weight mass, having a reversibly deformable soft structure and having dimensions that fit in a human hand for easy grasping, easy releasing and easy catching.

According to still further features in the described preferred embodiments each of the first weight and the second weight includes; (i) a bag; and (ii) grains filling the bag.

According to still further features in the described preferred embodiments the second weight has a mass of at least two thirds of the first weight mass, having a reversibly deformable soft structure and having dimensions fits to a human hand for easy grasping, easy releasing and easy catching.

According to still further features in the described preferred embodiments each of the first weight and the second weight includes; (i) a bag; and (ii) grains filling the bag.

According to still further features in the described preferred embodiments the bag's shape is selected from a group consisting of pear shape, egg shape, apple shape, cube shape, and loop or bagel shape.

According to another embodiment of the invention juggling instrument weight including: (a) envelope, having an opening for filling; (b) a means of closing the opening for filling; and (c) a filling substance at a suitable weight for performing juggling moves with the juggling instrument, wherein the filling substance type is selected from a group consisting of liquid or powder; wherein the material of the casing is resistant to leaking of the filling substance.

According to another embodiment of the invention a method for enabling a juggler to perform symmetrical poi's jugglers moves, the method including the steps of: (a) providing the juggler with a symmetrical poi, the symmetrical poi including: (i) a flexible long strap, wherein the dynamic friction coefficient between the flexible long strap and the skin of the juggler is at least 0.4, and wherein the length of the flexible long strap is at least 40 centimeters and is at most 120 centimeters; (ii) a first weight disposed at one end of the flexible long strap, the first weight having a reversibly deformable soft structure and having dimensions that fit in a human hand for easy grasping, easy releasing and easy catching, having a cross-section that is substantially identical to the cross-section of the flexible long strap in the contact area with the flexible long strap, and wherein the first weight has cross-section areas that change gradually, forming a tangential three dimensional shape with the flexible long strap; and (iii) a second weight disposed at the second end of the flexible long strap having a substantially identical mass to the first weight, having a reversibly deformable soft structure having dimensions that fit in a human hand for easy grasping, easy releasing and easy catching; and (b) performing symmetrical poi juggler's moves.

According to another embodiment of the invention the move is the throwing-and-catching move.

According to another embodiment of the invention the move is the palm-roll move.

According to another embodiment of the invention the move is the under-the-leg move.

According to another embodiment of the invention the move is the like-a-stick move.

According to another embodiment of the invention the move is the two-jugglers-with-three-poi move.

According to another embodiment of the invention the move is the butterfly-hand-switching move.

According to another embodiment of the invention the move is the butterfly-switch-throw move.

According to another embodiment of the invention the move is the parallel-and-throw move.

As used herein the specifications and claims, the term particle refers to any small solid body that can in large quantities serve as a filling for the symmetrical poi weight, examples of such particles are poppy seeds, sesame seeds, rice grains, wheat grains, cotton grains, sand, and flour.

Figure 5A:
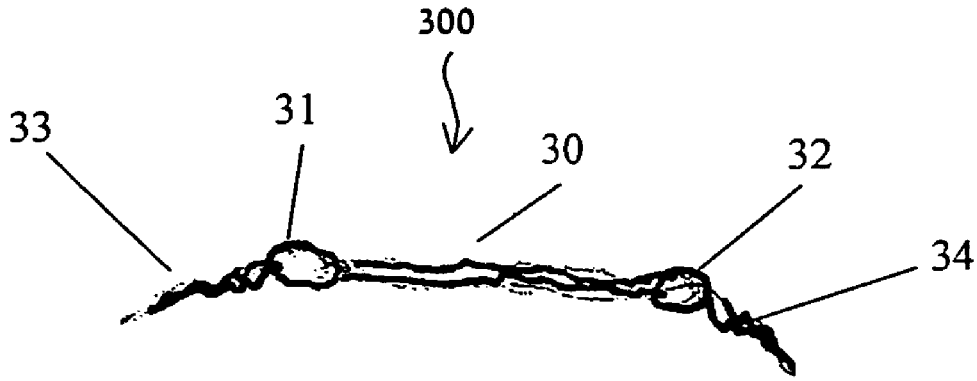

FIG. 5*a* is an artistic concept of one embodiment of the symmetrical poi according to the present invention.

Figure 5B:
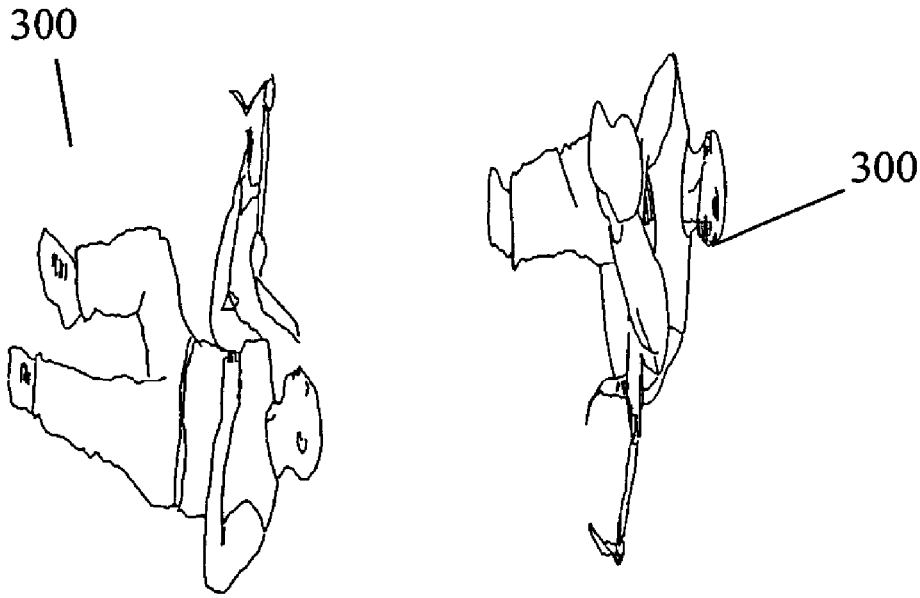

FIG. 5*b* illustrates an example of performing a move by two jugglers, using two symmetrical poi.

Figure 5C:
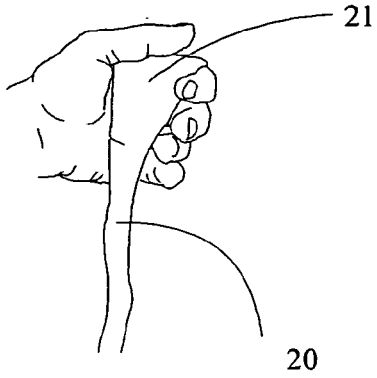

FIG. 5*c* illustrates palm grasping of the symmetrical poi in the hand of the juggler in sliding position.

Figure 5D:
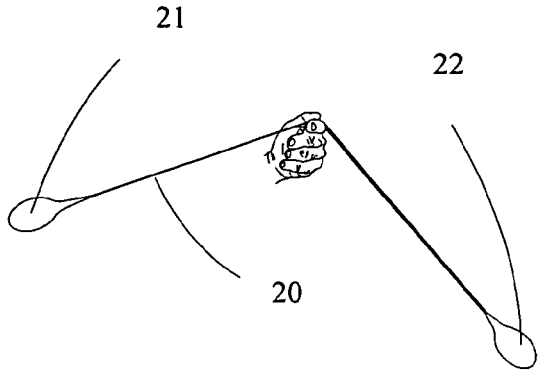

FIG. 5*d* illustrates rolling the flexible long strap of the symmetrical poi with the juggler's finger serving as a pivot.

Figure 5F:
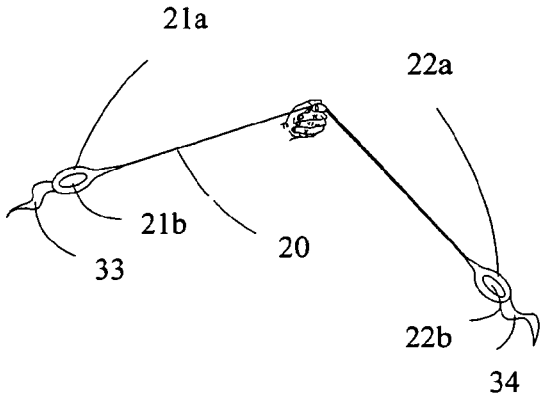
Figure 5E:
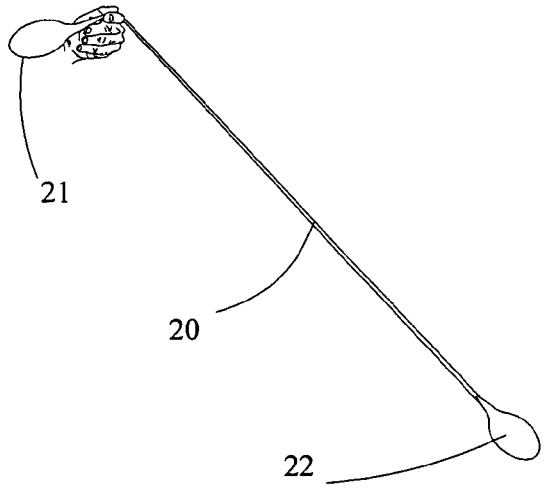

FIG. 5*e* illustrates an additional position of rolling the flexible long strap of the symmetrical poi.

FIG. 5*f* illustrates rolling the flexible long strap of the symmetrical poi with the juggler's finger serving as a pivot wherein the weights have holes and at the edge of each a banner is connected.

Figure 6A:
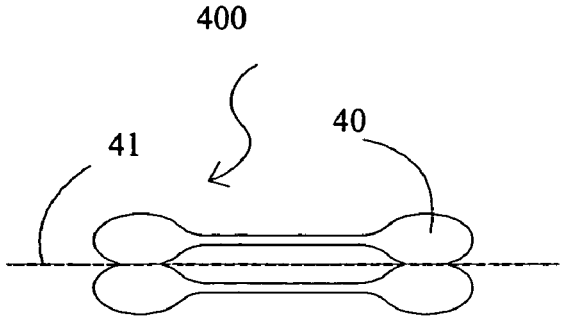

FIG. 6*a* is a schematic illustration of one possible way to cut the main part of a symmetrical poi structure according to the present invention.

Figure 6B:
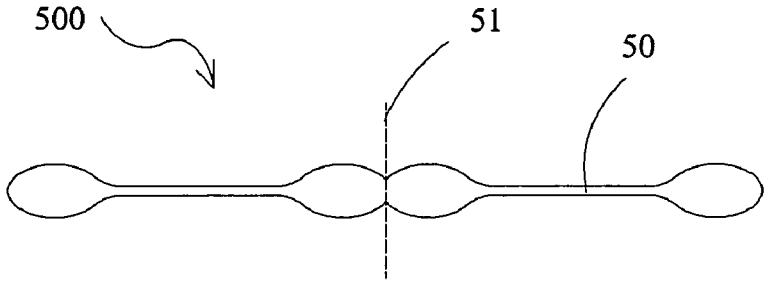

FIG. 6*b* is schematic illustration of another possible way to cut the main part of a symmetrical poi structure according to the present invention.

Figure 6C:
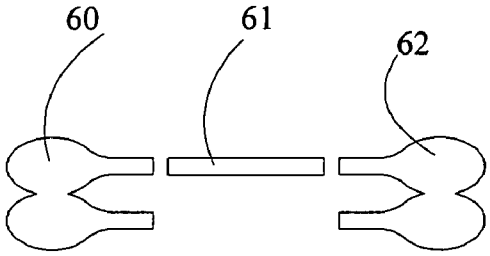
Figure 6D:
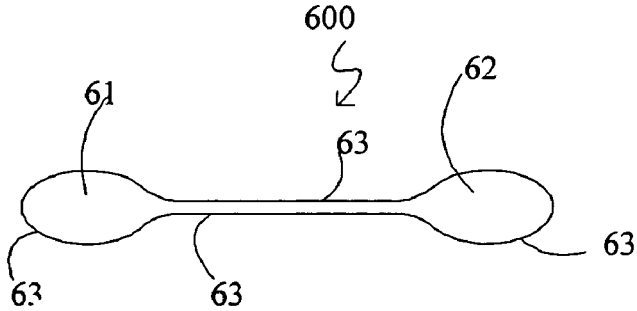

FIG. 6*c* is schematic illustration of yet another possible way to cut the part of the outer surface material of a symmetrical poi structure according to the present invention, and FIG. 6*d* is a schematic illustration of one option of an advanced stage in the production process of symmetrical poi.

Figure 7A:
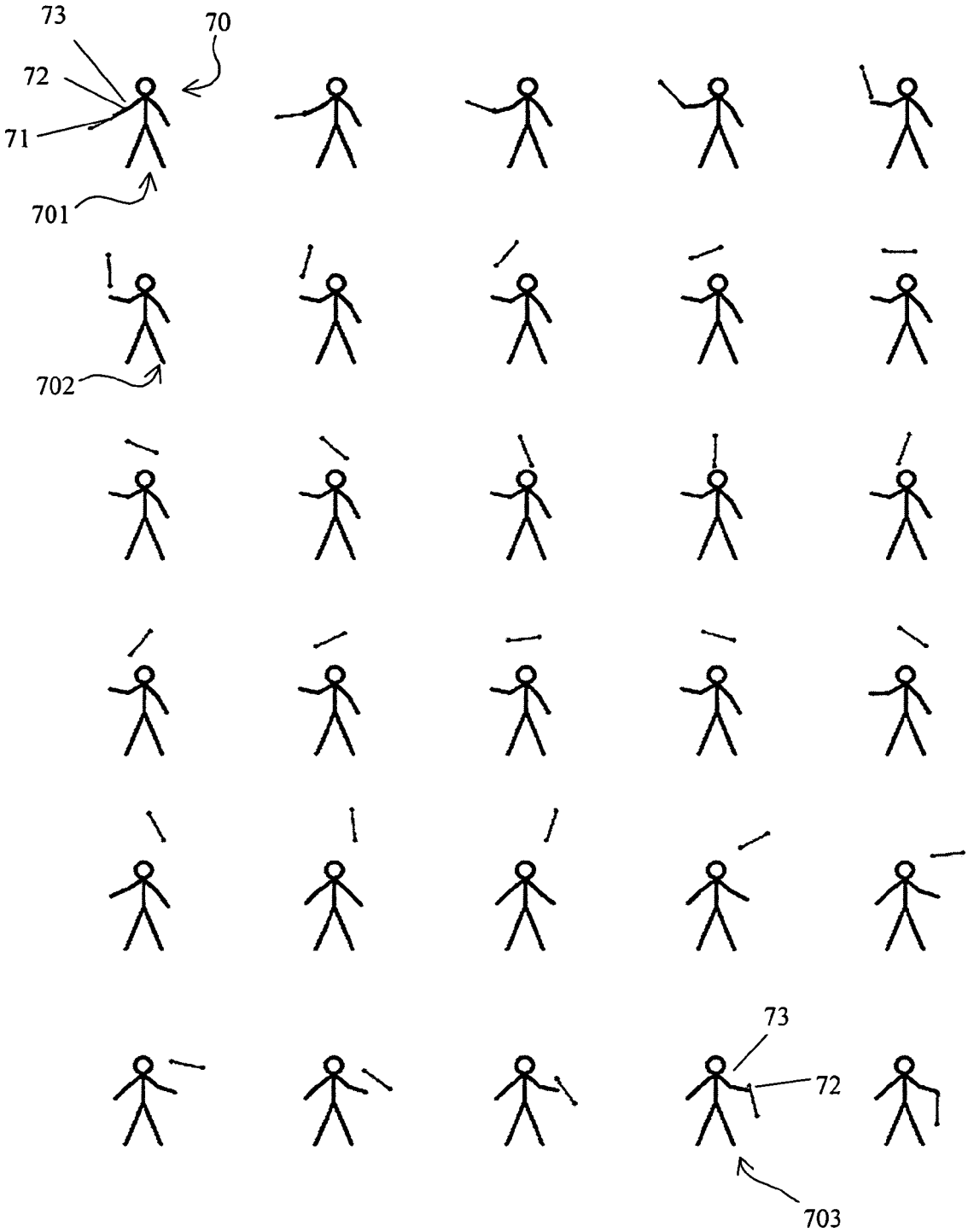

FIG. 7*a* is a schematic illustration of one possible symmetrical poi juggler's move, the throwing-and-catching move.

Figure 7B:
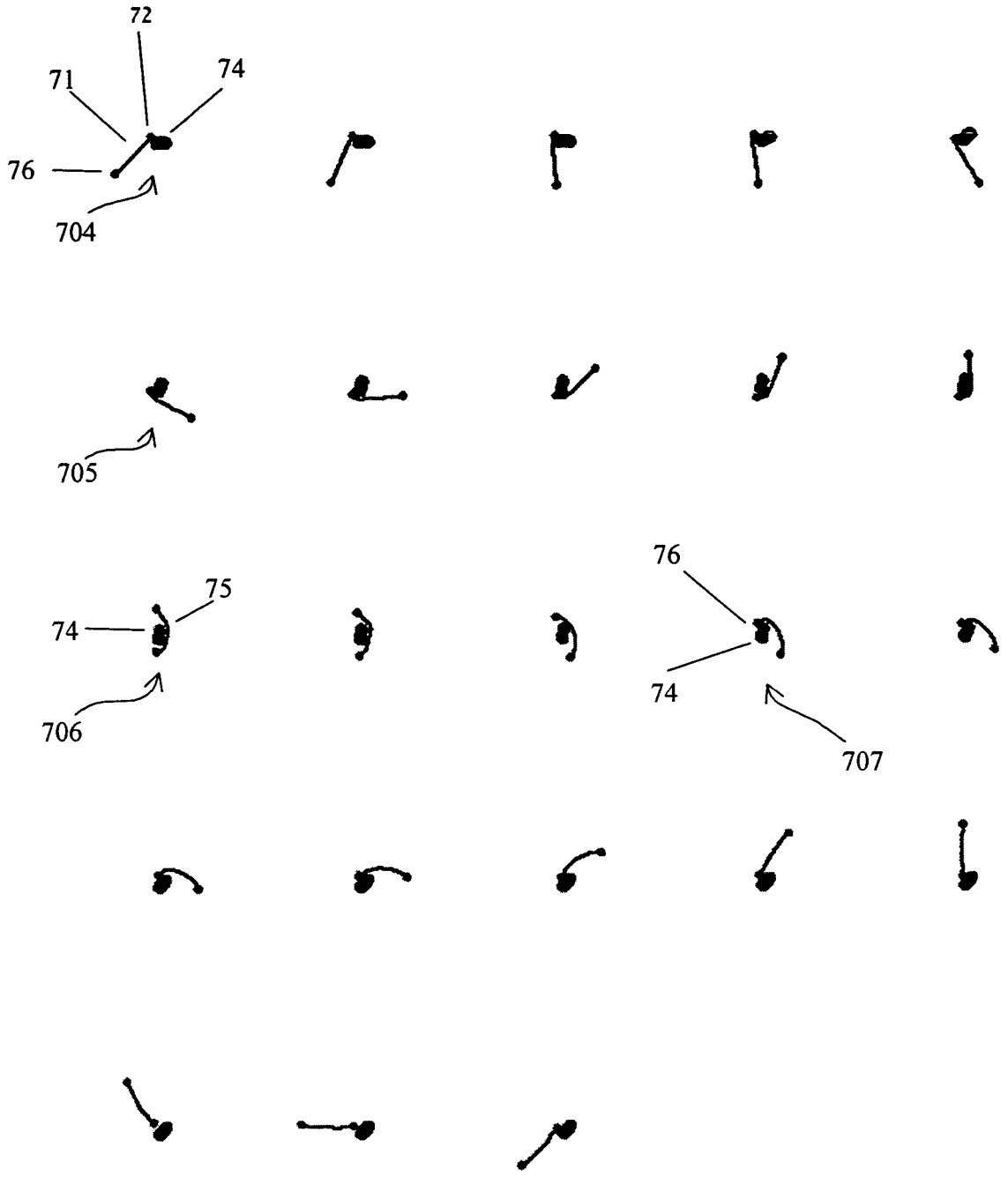

FIG. 7*b* is a schematic illustration of another possible symmetrical poi juggler's move, the palm-roll move.

Figure 7C:
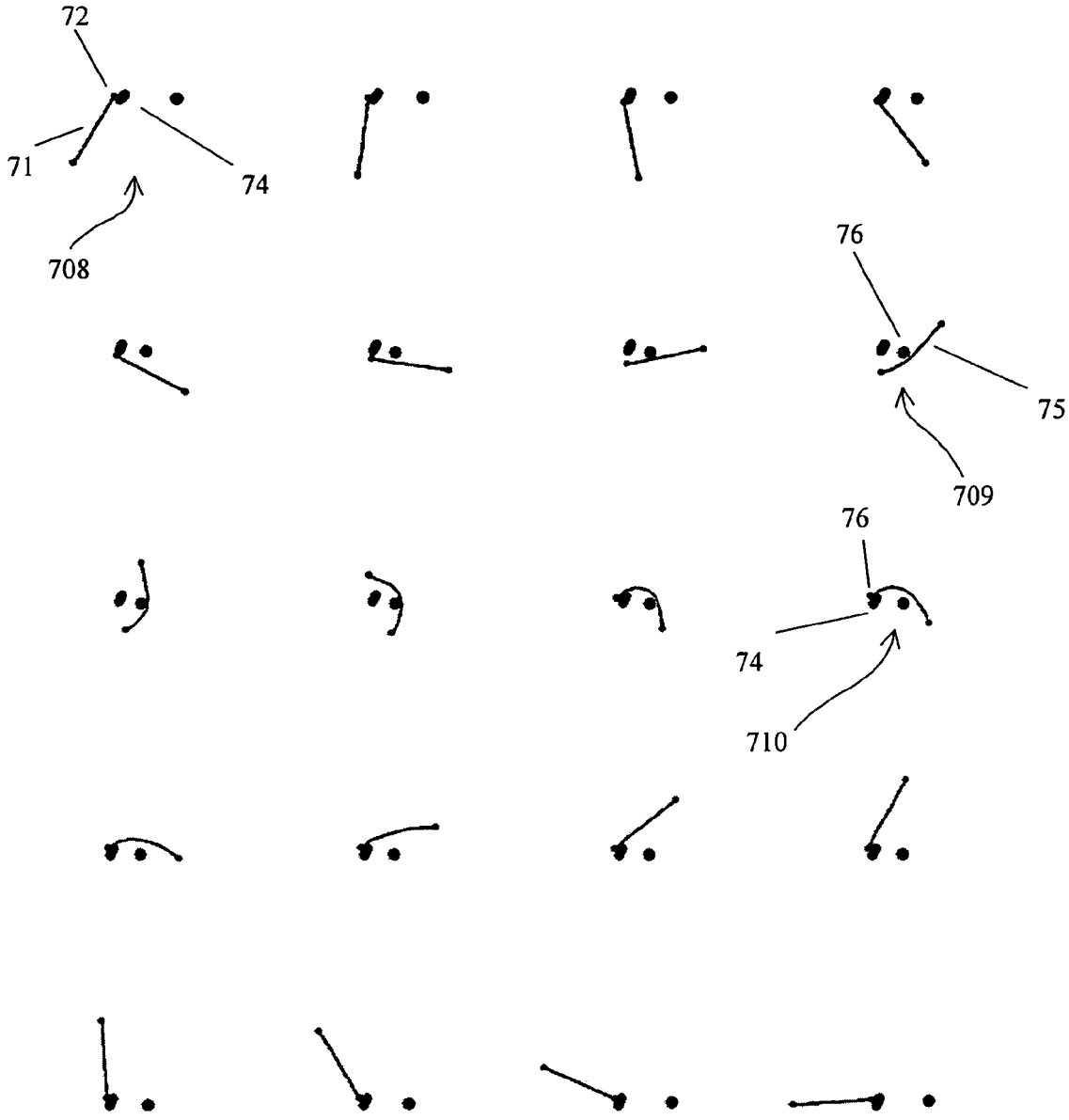

FIG. 7*c* is a schematic illustration of another possible symmetrical poi juggler's move, the arm-roll move.

Figure 7D:
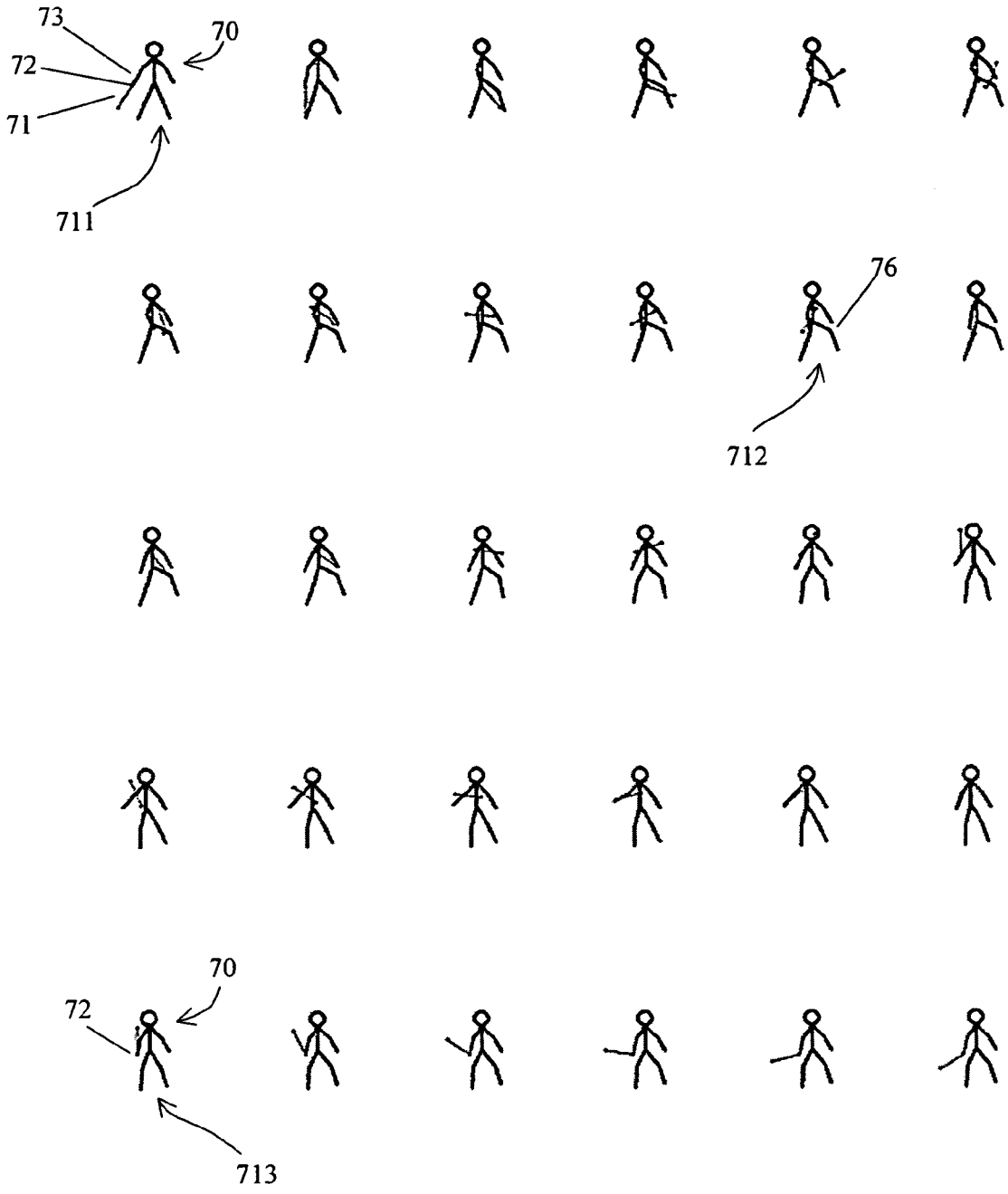

FIG. 7*d* is a schematic illustration of another possible symmetrical poi juggler's move, the under-the-leg move.

Figure 7E:
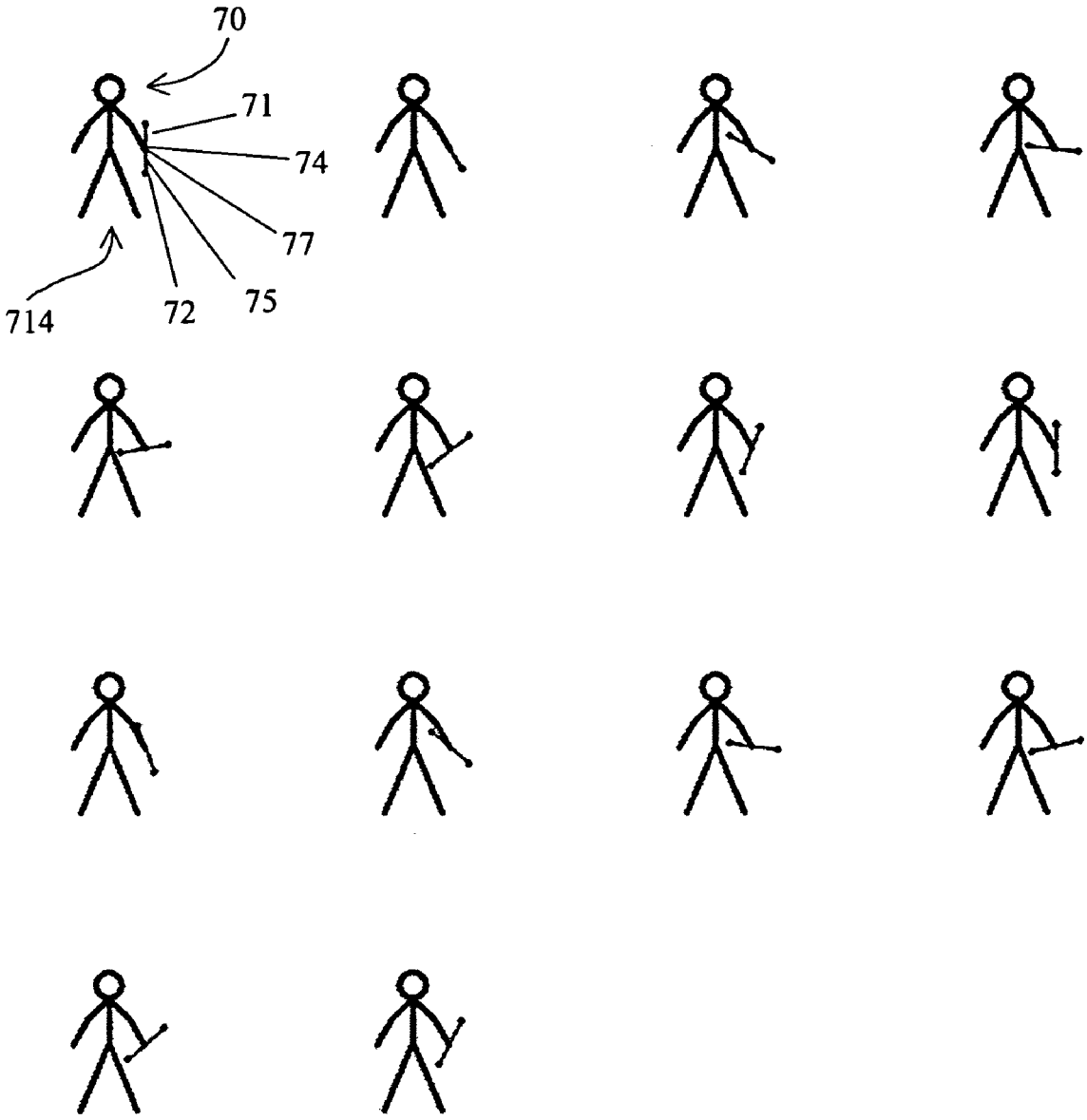

FIG. 7*e* is a schematic illustration of another possible symmetrical poi juggler's move, the like-a-stick move.

Figure 7F:
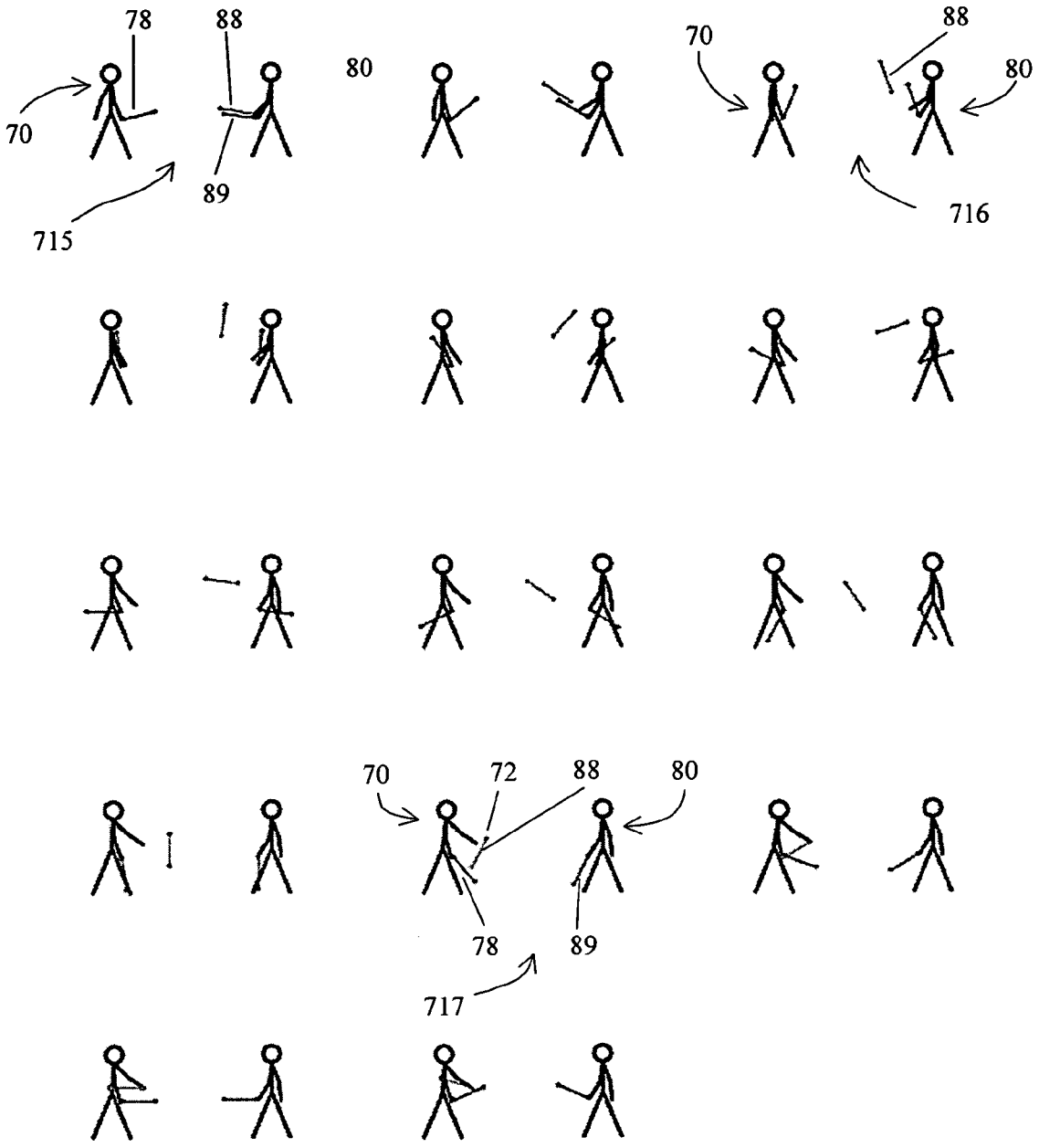

FIG. 7*f* is a schematic illustration of another possible symmetrical poi juggler's move, the two-jugglers-with three-poi move.

Figure 7G:
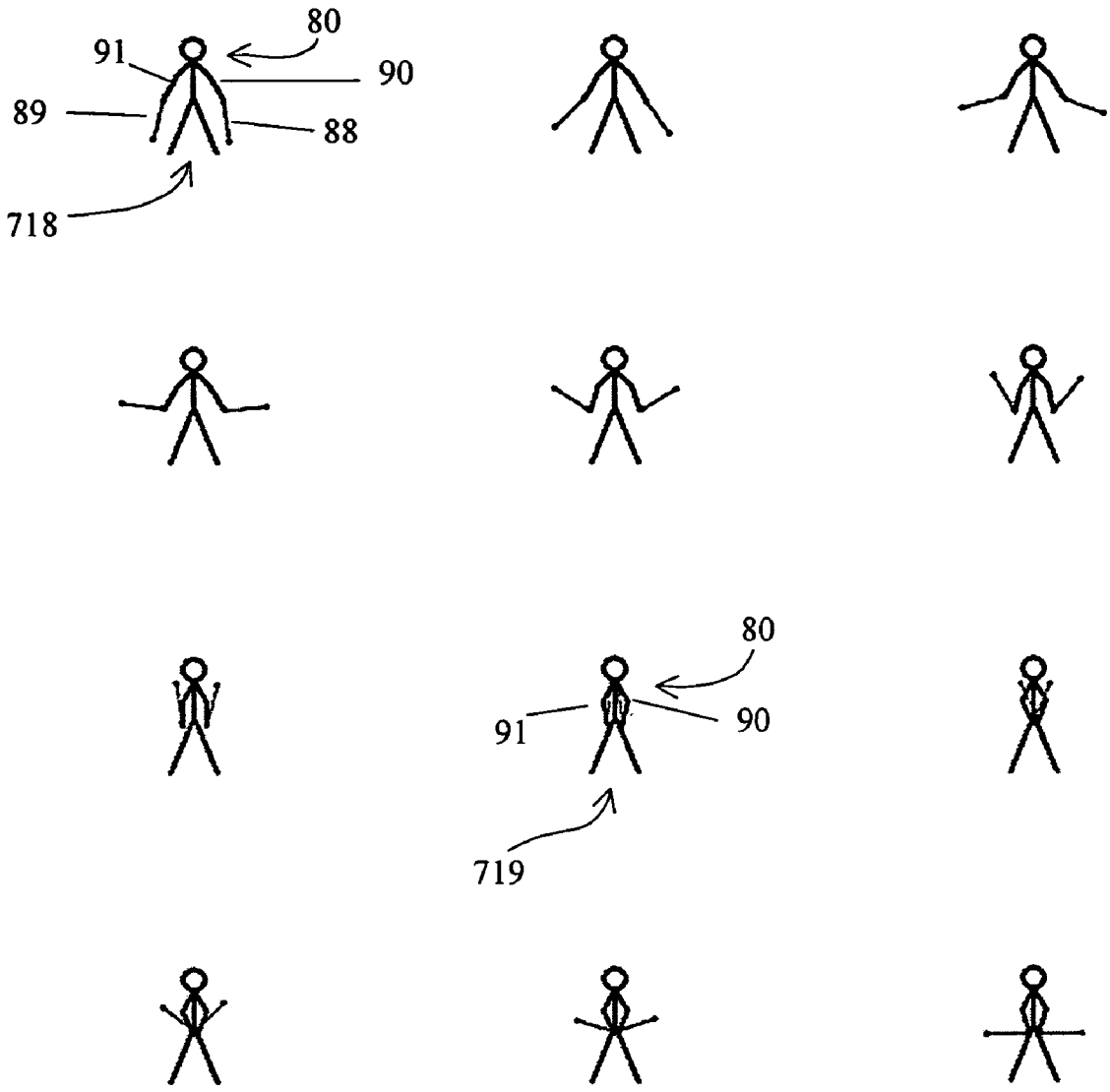

FIG. 7*g* is a schematic illustration of another possible symmetrical poi juggler's move, the butterfly-hand-switching move.

Figure 7H:
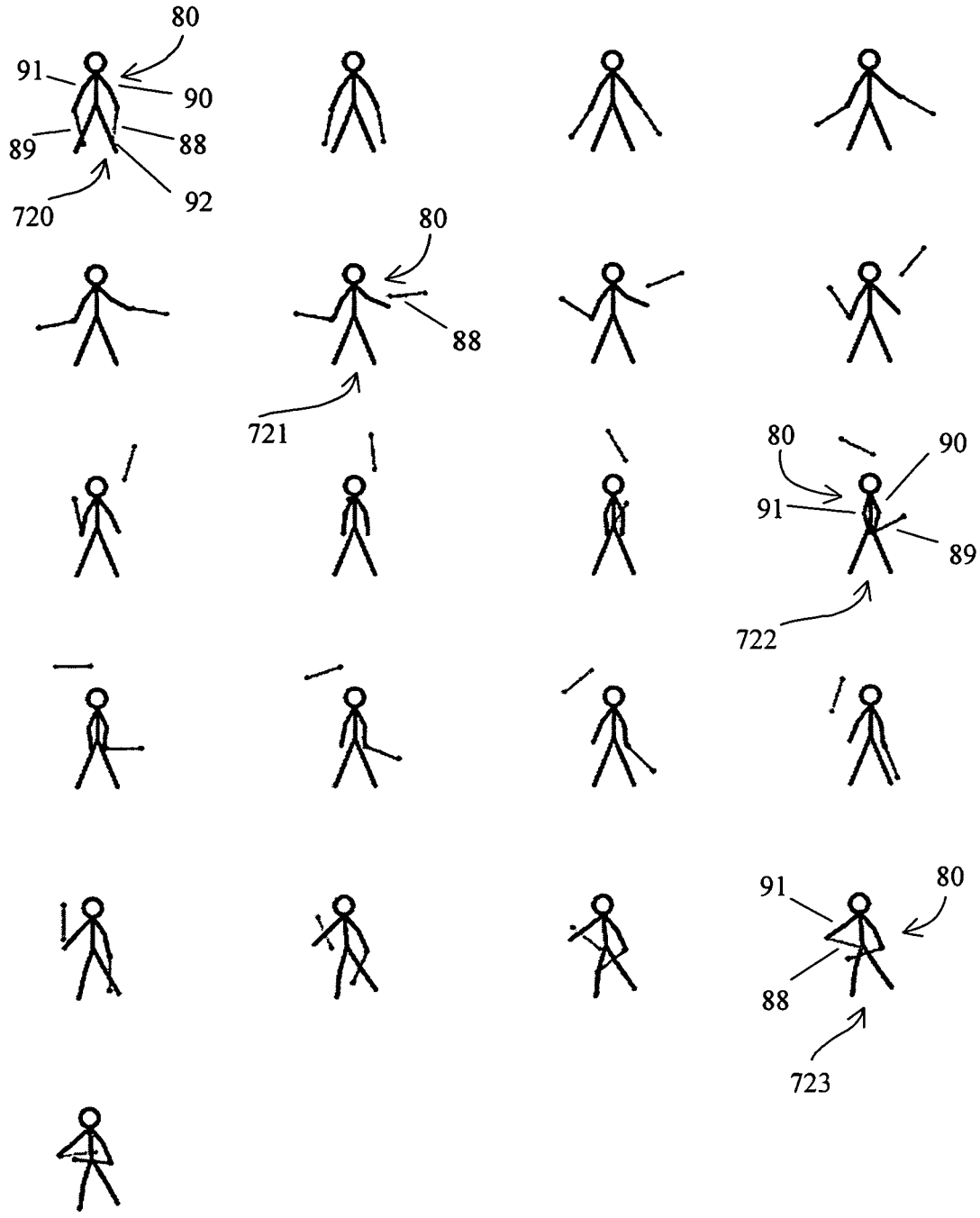

FIG. 7*h* is a schematic illustration of another possible symmetrical poi juggler's move, the butterfly-switch throw move.

Figure 7I:
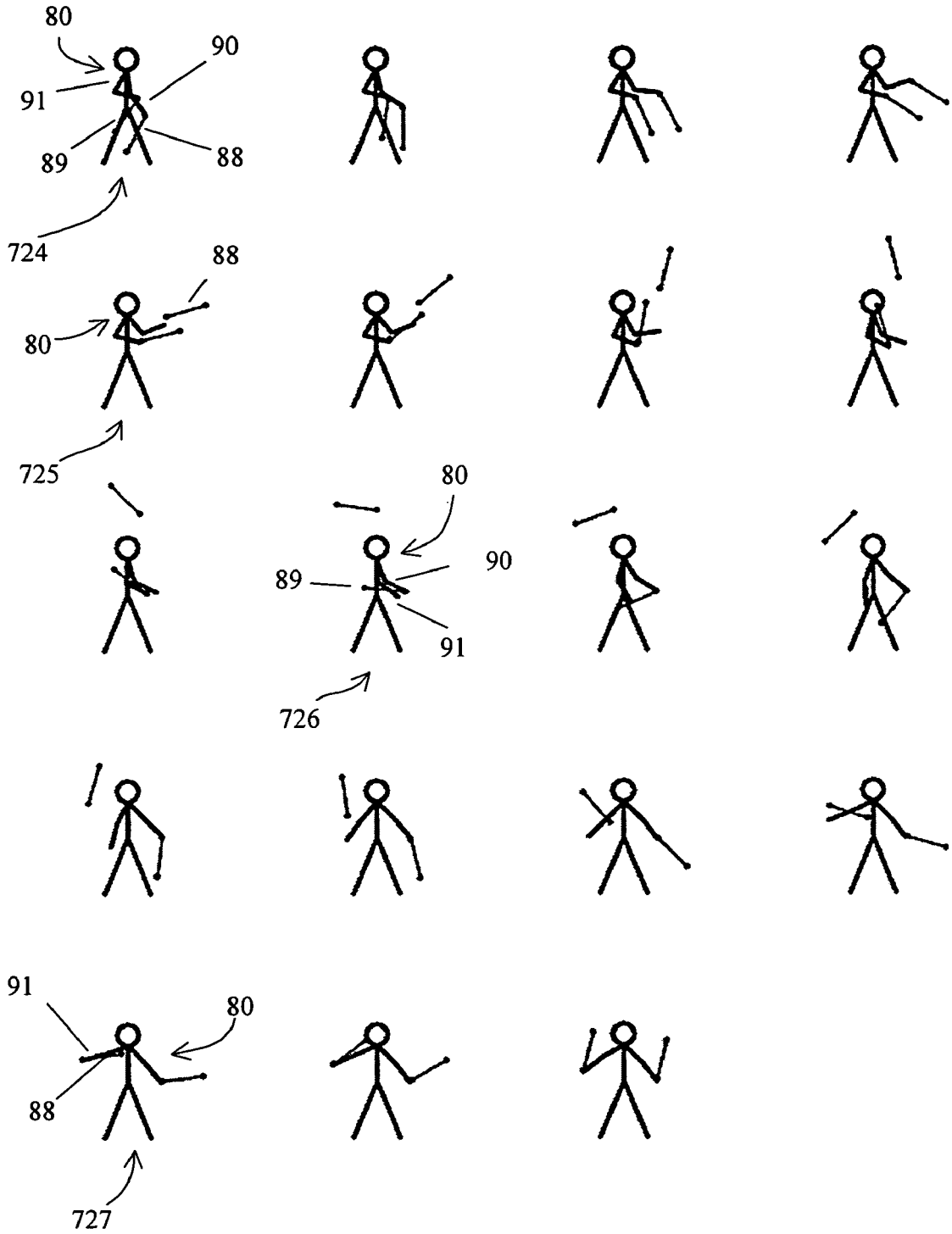

FIG. 7*i* is a schematic illustration of another possible symmetrical poi juggler's move, parallel-and-throw move.

DESCRIPTION OF THE PREFERRED EMBODIMENTS

The present invention relates to a safe swinging symmetrical poi configuration having two weights disposed at both ends of a flexible long strap with a rotational motion characteristic, enabling the performances of simple and complex moves that can not be performed by asymmetrical poi which are referred to as symmetrical poi juggler's moves.

As used herein the specifications and claims, the term symmetrical poi refers to a poi with of two essentially identical weights disposed at both ends of a flexible long strap, the weights are soft and enable easy grasping by a rotating hand and enabling easy releasing and easy catching, for performing juggling moves such as moves around the juggler's body or around a part of the juggler's body, or close to a juggler's body, or by throwing into the air, or throwing into the air and catching, by one juggler or by more than one juggler. Note that each one of the weights has two purposes, first, as a mass concentration required for the motions, and second as a handle.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

The principles and operation of a symmetrical poi according to the present invention may be better understood with reference to the drawings and the accompanying description.

Figure 1A:
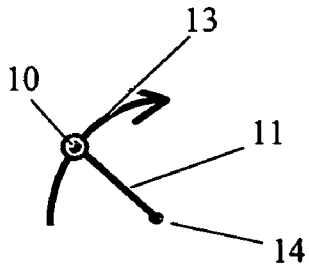
Fig. 1a (PRIOR ART)
FIG. 1*a* is a description of a rotational movement of one weight connected to a flexible long connector.

Referring now to the drawings, FIG. 1*a* is a schematic illustration of a prior art rotational movement of a weight 10 connected to a flexible connector 11 whose other end is at the center of a circular motion 14. The weight 10 is moving along the circular trajectory 13.

Figure 1B:
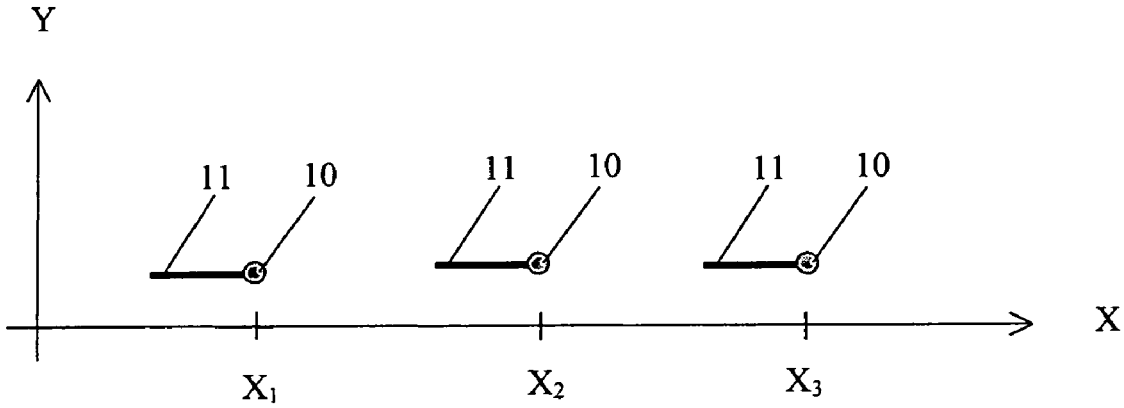
Fig. 1b (PRIOR ART)
FIG. 1*b* is a description of one weight connected to a flexible long connector, after leaving the other end that was at the center of a rotational movement.

FIG. 1*b* is a schematic illustration of a prior art of a weight 10 connected to a flexible connector 11, after leaving the other end that was at the center of a rotational movement. As described, the motion in orthogonal coordinate system X-Y has the nature of linear movement. FIG. 1*b* describes the orientation of the weight 10 and the connector 11, at three points. While the weight 10 and the connector 11 are moving at a constant Y coordinate, they cross three X coordinates, $X_1$, $X_2$, and $X_3$. That linear movement characterized with the lading movement of weight 10 dragging the connector 11 behind. The orientation of weight 10 connected to a flexible connector 11 in coordinate system X-Y is constant.

Figure 2A:
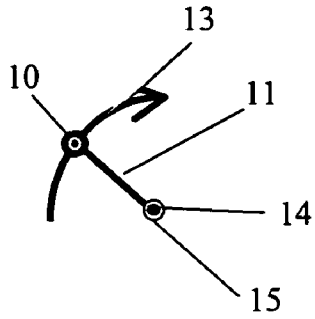
Fig. 2a (PRIOR ART)
FIG. 2*a* is a description of a rotational movement of one weight connected to a flexible long connector at one end and another weight connected to the second end, at the center of the circular motion.

FIG. 2*a* is a schematic illustration of a prior art of a rotational movement of a weight 10 connected to a flexible connector 11. In FIG. 2*a* a second weight 15, is connected to the flexible connector 11 at its other end and is held at the center of the circular motion 14. The description of the motion is identical to the description of the motion of FIG. 1*a*.

Figure 2B:
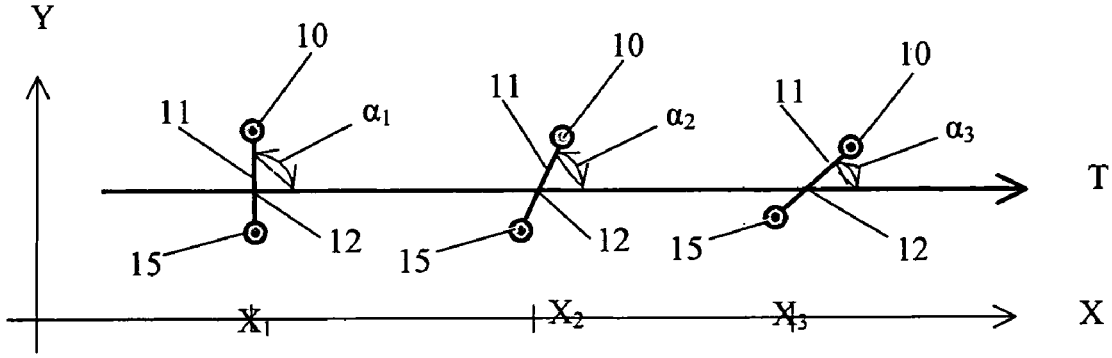
Fig. 2b (PRIOR ART)
FIG. 2*b* is a description of two weights, such as those of FIG. 1*a*, after leaving the holding at the end that was at the center of a rotational movement.

FIG. 2*b* is a schematic illustration of a prior art of two weights, weight 10 and weight 15 connected to each end of the flexible connector 11, after being released from hold at the end that was at the center of a rotational movement. The motion in orthogonal coordinate system X-Y has the nature of rotational movement. FIG. 2*b* describes the orientation of the weight 10, weight 15, and the connector 11, at three points. The center 12 of connector 11, is moving at a constant Y coordinate, crossing three X coordinates, $X_1$, $X_2$, and $X_3$, at the same time weight 10 and weight 15 and the flexible connector 11 have the nature of a rotational movement where the angle between the tensed flexible connector 11 and the linear trajectory T are changing from angle $\alpha_1$ at X coordinate $X_1$ to angle $\alpha_2$ at X coordinate $X_2$ and to angle $\alpha_3$ at X coordinate $X_3$. The geometrical center 12 of connector 11 positions is substantially identical to the position of the center of gravity of weight 10, weight 15 and the flexible connector 11.

Figure 3A:
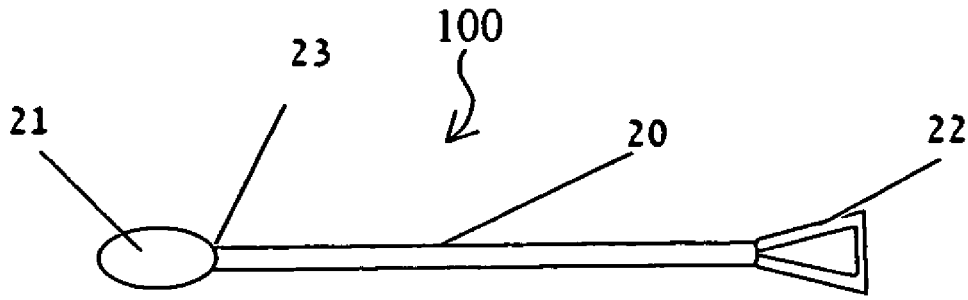
Fig. 3a (PRIOR ART)
FIG. 3*a* illustrates a prior art typical poi structure.

FIG. 3*a* illustrates a typical prior art poi structure, referred to herein below as poi structure 100. Said poi structure 100 includes a flexible long connector 20, a weight 21 and a handle 22. Weight 21 is connected to flexible long connector 20 in the area of contact 23 said area of contact is geometrically discontinuous between the outer casings of the connector 20 and weight 21.

Figure 3B:
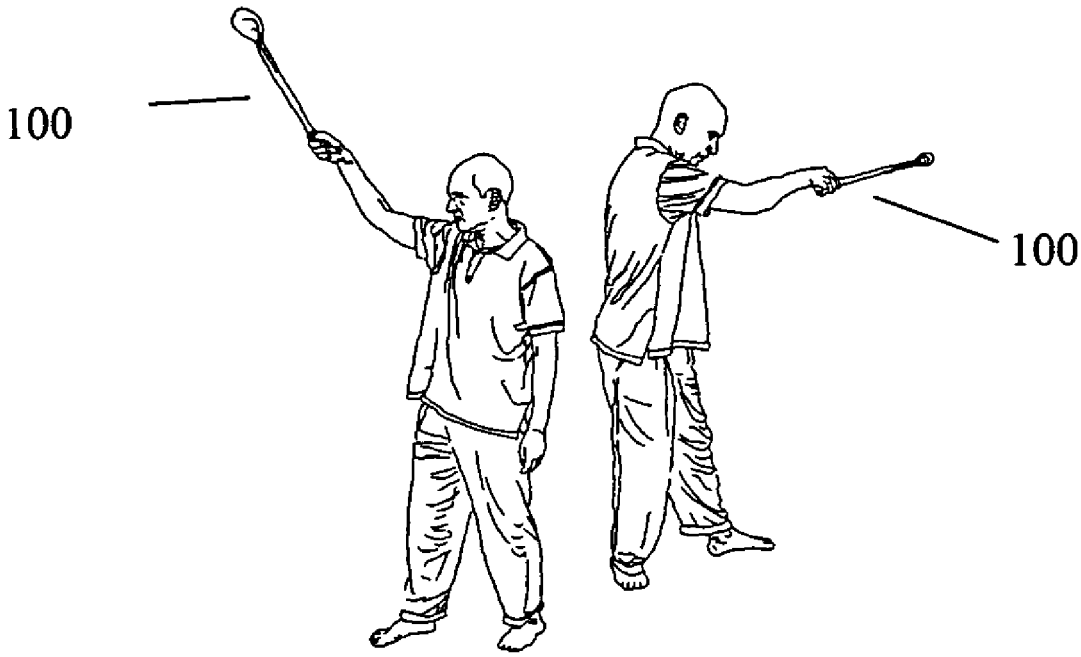
Fig. 3b (PRIOR ART)
FIG. 3*b* illustrates an example of performing a move by two jugglers, using a prior art poi.

FIG. 3*b* is a schematic illustration of an example of performing moves by two jugglers, using said prior art poi 100.

Figure 4A:
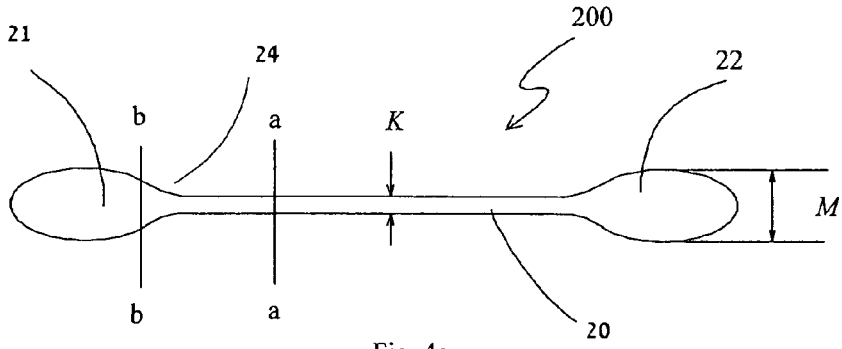
FIG. 4*a* is a schematic illustration of the symmetrical poi according to one embodiment of the present invention.

FIG. 4*a* is a schematic illustration of the symmetrical poi according to one embodiment of the present invention. The symmetrical poi enables performing all of the regular moves that can be performed with a regular poi, as well as unique juggling moves, known as symmetrical poi juggler's moves, some of which are performed with the juggler holding or touching the symmetrical poi 200 with both hands, some of which are performed with the juggler holding or touching the symmetrical poi 200 with one hand, and some of which are performed with the symmetrical poi 200 in the air, without any human contact.

Symmetrical poi 200 includes poi with two essentially identical weights, weight 21 and weight 22 at both ends of a flexible long strap 20.

The flexible long strap according to the present invention can be of one layer of material or several layers of connected material and even an exterior casing with internal filling or without internal filling, as long as the cross section of the flexible long strap has an aspect ratio of a higher value than a defined value. The term "aspect ratio" refers to the relation between the width and the height of an imaginary rectangle inscribing the shape of the cross section.

Numerous attempts to perform unique juggling moves with the symmetrical poi have shown that there is a strong correlation between the parameters of the symmetrical poi and the juggling moves that can be performed with it. These parameters also include the geometrical ratios between its components, its absolute dimensions and weights, the materials, and the friction coefficients. A good example of this correlation is the parameters of the flexible long strap, which influence its bending and twisting qualities and its behavior when in contact with the skin of the juggler's palm or back of the hand when performing juggling moves. The behavior of the flexible long strap is particularly important when performing sliding motion of the flexible long strap in contact with the juggler's palm or back of the hand, or even one of the juggler's fingers, so that even when there is rolling motion, namely partial dynamic wrapping of the flexible long strap around the juggler's palm, back of the hand, or even one of the fingers.

The numerical values noted in the description and the numerical limitations mentioned in the claims are the result of the vast cumulative experience in performing symmetrical poi juggler's moves.

The purpose of the flexible long strap in the symmetrical poi configuration is also to transfer tension forces between the two weights. The weights can be connected to the flexible long strap at a certain stage of the production process of the symmetrical poi, or be created from one piece of material, of any reasonable structure.

Weight 21 is soft and enables easy grasping by a rotating hand, and enables easy releasing and easy catching. One possible constitution of weight 21 is a bag filled completely or partially with grains such rice grains, wheat grains, sorghum grains, or cotton grains or a combination of two or more types of grains. The shape and the geometrical dimension of the bag of weight 21 and the grains mass inside that bag are chosen, among other requirements, according to the human palm to ensure the characteristics of easy grasping easy releasing and easy catching. The juggler's control of the symmetrical poi is achieved to a great extent by the juggler's ability to move his wrist joint and grasp the weight 21 in a wide variety of quickly changing positions. The unique structure of the weight 21 enables grasping it in the palm of the hand with several fingers, as well as between two fingers, such as the thumb and index finger, which are pinching the casing of the weight 21, which is distorted accordingly. The softness characteristic of the bag of weight 21 is also a safety requirement, for preventing injury in case of impact.

Both weight 21 and weight 22 serve two purposes, one is to serve as a weight and the other is to serve as a handle, thus enabling performance of the unique symmetrical poi juggler's moves as well as the moves usually performed with the poi.

A symmetrical poi's bag can have many shapes, including: pear shape, egg shape, apple shape, loop or bagel shape, etc.

The length dimension of the flexible long strap 20 is much greater than the width dimension of the flexible long strap 20 therefore its terminology includes the word long. The length dimension of the flexible long strap 20 and the grains mass inside the bag of weight 21 are chosen, among other requirements, according to the juggler's body dimensions for enabling the performance of symmetrical poi juggler's moves such as moves around the juggler's body or around a part of the juggler's body, or close to the juggler's body, or by throwing into the air, or throwing into the air and catching, by one juggler or by more than one juggler.

Weight 22 is essentially identical to weight 21 in shape, geometrical dimension, and the grains type and mass.

The illustration shows two section lines, section a-a across flexible long strap 20 and section b-b across weight 21. The transition area 24 between weight 21 and flexible long strap 20 is gradual with regard to the surface of their outer casing. Thus every sliding motion of the symmetrical poi 200 from the flexible long strap 20 to the weight 21 over any part of the juggler's hand is essentially a sliding motion of continuous tangential spatial surfaces, namely without any discontinuousness between surfaces and with continuous gradual growth of the area of the section of symmetrical poi 200, excluding connection means such as stitches and adhesions.

The mechanical and dynamical behavior of the components of the symmetrical poi 200 is so that the flexible long strap 20 can resist a tension force, and cannot resist any meaningful torque and bending moments, the grains can move inside the bags according to the grasping hand forces and the inertial, gravitational, centrifugal and other forces. Any collision of weight 21 and weight 22 would be a plastic collision.

In order to enable performance of the symmetrical poi juggler's moves, the dimensions of the symmetrical poi must maintain geometrical ratios within defined boundaries, as well as absolute dimensions within defined boundaries, relative to the dimensions of the juggler's body. Thus a symmetrical poi for a child with small body dimensions may be of a different size than those of a symmetrical poi for an adult juggler.

The illustration shows the width dimension of the flexible long strap marked by the letter "K" and the width dimension at the widest part of weight 22 marked by the letter "M". The vast cumulative experience in use of the symmetrical poi teaches that K must be no smaller than 8 mm and no larger that 30 mm, and the K:M ratio must be within the boundaries of 1:1.3 to 1:7.

Figure 4B:
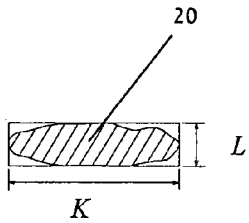
FIG. 4*b* is a schematic illustration of a cross section in the flexible long strap of the symmetrical poi according to one embodiment of the present invention.

FIG. 4*b* is a schematic illustration of cross section a-a in the strap of the symmetrical poi according to one embodiment of the present invention. The section can fill an imaginary inscribing rectangle with sides K and L. According to the complexity of the symmetrical poi juggler's moves, the inscribing rectangle can have an aspect ratio larger than a defined value, such as 10, and a width dimension within a defined range, such as from 8 mm to 30 mm.

Figure 4C:
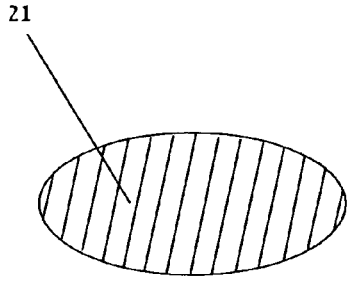
FIG. 4*c* is a schematic illustration of a cross section in one of the weights of the symmetrical poi according to one embodiment of the present invention.

FIG. 4*c* is a schematic illustration of cross section b-b in one of the weights of the symmetrical poi according to one embodiment of the present invention. The section shape can start like the shape of section a-a in proximity to the flexible long strap 20 with its area increasing the farther it is from flexible long strap 20 and then decreasing gradually. The section shape is not fixed and can change according to the forces exerted at any given moment on weight 21, including the grasping force of the juggler's hand, however other than certain cases in which objects exert forces that distort the desired form of weight 21, during normal use the section area changes gradually, enabling the sliding of the juggler's closed hand over every part of the symmetrical poi 200 with gradual change of the form of the hand grasp.

Various types of juggling apparatus include a weight component. Shipment of such an apparatus and particularly air shipment of a large commercial quantity of such an apparatus is expensive. According to the present invention, the juggling apparatus includes a weight casing which is empty when shipped, and is later filled with a suitable filling, creating the weight.

Figure 4D:
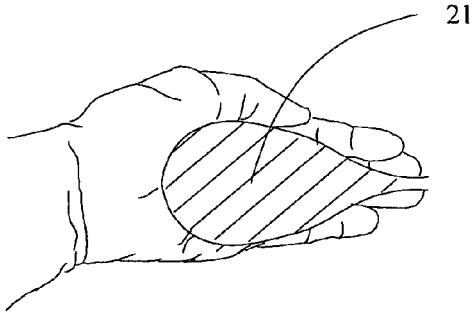
FIG. 4*d* is a schematic illustration of a cross section of one of the weights of the symmetrical poi according to one embodiment of the present invention.

FIG. 4*d* is a schematic illustration of a cross section of one of the weights 21 of the symmetrical poi 200 according to one embodiment of the present invention. The structure of the weight 21 is a compromise and optimization of factors such as shape, volume and weight, and conforming to the shape of a hand. In the favored structure, the weight 21 has an elongated shape, which conforms to the elongated shape of a palm with fingers when the weight is dispersed inside it, and has an area with a large section, according to the size of the palm, which tapers towards the fingers.

The perfect conformity to the palm, combined with the quality of deformability, enable efficient utilization of the flexibility of the palm and achieving good maneuverability, which has a major effect on performance.

Working with the symmetrical poi 200, involves a great deal of moving from one hand to the other. The gradual changing of the weight's cross-section areas enables the receiving hand to adapt to the flexible long strap 20 near the weight 21 and then while closing the palm on flexible long strap 20 the receiving hand slides outwards towards the weight until full grasping is achieved in movement. The receiving hand appears to pull symmetrical poi 200 from the original hand instead of waiting to receive it. This enables easy catching seeing as the process is gradual and requires neither high precision nor precise catching for the weight to slide into the hand. Furthermore, the juggler actually begins the next move while catching, thus creating more harmonious and fluid movement than a situation in which the juggler needs to stop in order to catch at a precise position and only then begin the next move.

Figure 4E:
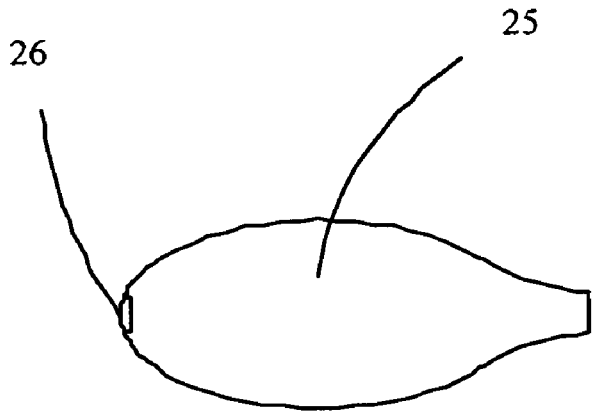
FIG. 4*e* is a schematic illustration of a weight casing for filling with liquid by the user of the symmetrical poi according to one embodiment of the present invention.

FIG. 4*e* is a schematic illustration of a weight casing 25, for filling with liquid by the user of the symmetrical poi according to one embodiment of the present invention. Weight casing 25 is made of a flexible material that is resistant to the designated liquid, such as water, and has an opening for filling that can be sealed with a plug 26.

Figure 4F:
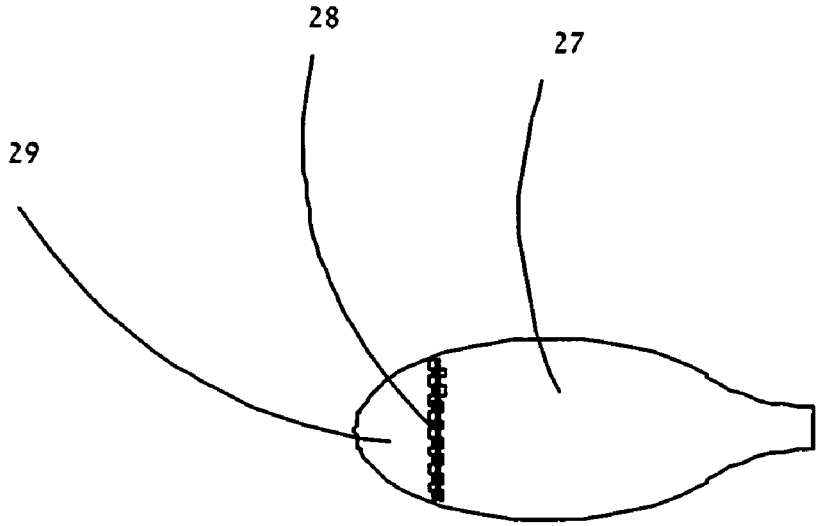
FIG. 4*f* is a schematic illustration of a weight casing for filling with solid particles of the symmetrical poi according to one embodiment of the present invention.

FIG. 4*f* is a schematic illustration of a weight casing 27 for filling with solid particles by the user of the symmetrical poi according to one embodiment of the present invention. Weight casing 27 is of a flexible material and is resistant to the leakage of the designated particles, such as sand, grains, or solid powders.

A zipper 28 enables detachment of part 29 from the weight casing 27 for exposing the filling opening.

An additional option is leaving an opening for filling at the end of weight casing 27 that closes with a lace, elastic band, or any other suitable means of closing. The filling material of weights in juggling apparatus tends to erode. When the material is organic, the weights also stand the risk of developing pests that could be harmful to wares in nearby storage. The use of material for filling by the user enables the use of available, simple, and inexpensive materials that can be easily replaced as needed.

Weight casing 25 for filling with liquid by the user and weight casing 27 for filling with solid particles by the user can be a fixed structural part permanently connected to the symmetrical poi as part of its outer casing or as an internal component, and can also be components that can be attached to or removed from the symmetrical poi via suitable opening that can be closed.

FIG. 5*a* is an artistic concept of one embodiment of the symmetrical poi according to the present invention. Symmetrical poi 300 is a symmetrical poi with two essentially identical weights, weight 31 and weight 32 at both ends of a flexible long strap 30. A flexible strip 33 is connected to weight 31 and a flexible strip 34 is connected to weight 32. Strip 33 and strip 34 the shape of both of which can be the shape of an elongated banner, are examples of the possibility to add to symmetrical poi 300 means in order to increase to visual and sound effect of the symmetrical poi 300 juggling moves.

FIG. 5*b* illustrates an example of performing symmetrical poi juggler's moves by two jugglers, using two symmetrical poi 300. Each of the jugglers can perform independent symmetrical poi juggler's moves and can also perform symmetrical poi juggler's moves combined with exchanging the symmetrical poi with each other.

FIG. 5*c* illustrates the grasping of a symmetrical poi in the juggler's hand in sliding mode. The illustration shows part of the flexible long strap 20 dangling from the juggler's hand and part of the weight 21 held gently by the juggler. As the juggler slides the symmetrical poi in his hand, he has to gradually change his grasp seeing as the section area of the symmetrical poi changes. In order to enable well-controlled sliding, the change in the section area needs to be gradual, and the friction between the symmetrical poi and the juggler's hand needs to be suitable for the move being performed. This friction is greatly determined by the type of material that the external casing of the symmetrical poi is made of, and this material can be selected by an experienced juggler after extensive practice. Furthermore the absolute dimensions of the symmetrical poi's components have a great deal of influence on the sliding motion.

FIG. 5*d* illustrates rotation of the flexible long strap 20 of the symmetrical poi with the juggler's finger serving as a pivot. The combination of gravitational force and centrifugal forces exerted on weight 21 and on weight 22 determine the bending angle created in the strap 20 at the pivot point.

FIG. 5*e* illustrates an additional form of rotation of the flexible long strap 20 of the symmetrical poi after a rotation of several rotations, when the weight 21 reaches the juggler's hand.

The qualities of the contact between the flexible long strap 20 and the juggler's finger are highly significant, particularly to prevent any damage such as bruising or laceration, and to enable the juggler to have good control of the rotation, which is rotation without sliding, namely, the juggler can start rotating with his finger near one of the weights and after several full rotations the juggler's finger will reach the other weight. Seeing as the rotation is without sliding, each full rotation changes the location of the pivot on the flexible long strap 20, by the same distance as the circumference of the juggler's finger.

FIG. 5*f* illustrates rolling the flexible long strap 20 of the symmetrical poi with the juggler's finger serving as a pivot wherein weight 21*a* has a hole 21*b*, creating a shape similar to a hoop with external contours according to the shape of the weight 21, that does not necessarily have a round cross section at any given part, and the opposite side of which there is a flexible long strap 20 to which a banner 33 is connected. Weight 22*a* has a similar structure with a hole 22*b* and a banner 34. The holes in the weights add an additional dimension of options for grasping with the fingertips for performance of moves, an furthermore enable rotation of the entire symmetrical poi around a finger stuck in the hole in the weight. The banners also improve the ability to perform juggling moves, both by serving as another option for grasping the symmetrical poi if the intended grasp is missed, and as a means of extending.

FIG. 6*a* is a schematic illustration of one possible way to cut the main part of a symmetrical poi structure according to the present invention. The first stage of the production process of symmetrical poi 400 (not shown) can be the cutting of a piece of linen, fabric, or any other suitable material at a shape as illustrated by the geometric form 40.

The material is folded along the long symmetrical axis 41 at a later stage of the production process.

FIG. 6*b* is schematic illustration of another possible way to cut the main part of a symmetrical poi structure according to the present invention. The first stage of the production process of symmetrical poi 500 (not shown) can be the cutting of a piece of linen, fabric, or other suitable materials at a shape as illustrated by the geometric form 50. The material is folded along the short symmetrical axis 51 at a later stage of the production process.

FIG. 6*c* is schematic illustration of yet another possible way to cut the part of the outer surface material of a symmetrical poi structure according to the present invention. Here the material is cut into to three pieces. Piece 60 is designated for the flexible long strap of the symmetrical poi, piece 61 is designated for the first weight of the symmetrical poi, and piece 62 is designated for the second weight of the symmetrical poi.

FIG. 6*d* is a schematic illustration of one possible advanced stage in the production process of symmetrical poi 600. Here the piece of material, shaped as illustrated by the geometric form 40 at FIG. 6*a* is folded along the long symmetrical axis 41 and the edges are sewed. The sewing lines are described by the contour lines 63.

Part 60 of the material creates the flexible long strap of the symmetrical poi. Part 61 and part 62 of the material create the first weight and the second weight bags of the symmetrical poi. The grains mass of the weights are filled into the weight bags at the proper stage of the production process.

The main advantage of the symmetrical poi is that new attractive moves can be performed using it, as well as improvement of known poi's juggler moves. Basic move elements that can be performed with symmetrical poi include:

Throwing and catching.

Easy switching of holding of the symmetrical poi from one hand to the other.

Easy switching of holding of the symmetrical poi from one hand holding to two hands holding.

Passing a spinning symmetrical poi between two jugglers.

Swinging around the symmetrical poi's center, while holding the symmetrical poi.

Swinging around the symmetrical poi's center, after releasing the symmetrical poi from the hand.

Transferring grip from one end to the second end, with a rotational movement around one palm.

Swinging around one foot and transferring grip from one end to the second end.

Throwing into the air for the purpose of untying two symmetrical poi.

Twisting on objects in various ways.

The combination of basic move elements enabling the performance of many symmetrical poi juggler's moves.

Symmetrical poi juggler's moves are displayed here in the figures by a series of positions with short intervals between them describing a complete move. In each figure, starting with FIG. 7*a* and ending with FIG. 7*i*, the first position is in the left side of the upper row, the next position is immediately to the right until the end of the row. The illustration continues one row beneath, starting at the left side and so on. The last position is on the right side of the bottom row.

All the moves that are described here by verbally and illustrated or not illustrated here in the figures are based on real experience of performing them with a symmetrical poi.

FIG. 7*a* is a schematic illustration of one possible symmetrical poi's juggler's moves, the throwing-and-catching move. The throwing-and-catching move starts with position 701. Juggler 70 holds one of the symmetrical poi's weights 72 by one hand 73 and rotates the symmetrical poi 71 on a vertical plane. The move is continued by throwing the symmetrical poi 71 into the air in position 702. After some time in position 703 catching one of the symmetrical poi's weights 72 by one of the juggler's hands 73. It is possible to maintain the rotational direction after catching, or reversing it by a pendulum movement.

FIG. 7*b* is a schematic illustration of another possible symmetrical poi's juggler's moves, the palm-roll move. In palm-roll move the holding of the symmetrical poi 71 is reversed from holding one of the symmetrical poi's weights 72 by one of the juggler's palms 74, (illustrated here as cutting through the palm) to holding the other of the symmetrical poi's weights 76. The move starts with position 704. The juggler's palm 74 holds the symmetrical poi's weight 72 and rotates the symmetrical poi 71. In position 705 the symmetrical poi's weight 72 is released. The illustration show that in position 706 the symmetrical poi's flexible long strap 75, is in contact with the juggler's palm 74 and is banding around it. In position 707 the second symmetrical poi's weight 76 is caught and held by the juggler's palm 74, and the rotation is continued.

FIG. 7*c* is a schematic illustration of another possible symmetrical poi juggler's moves, the arm-roll move. The arm-roll move starts with position 708. The juggler's palm 74, (illustrated here as cutting through the palm) holds the symmetrical poi's weights 72 and rotates the symmetrical poi 71. In position 709 the symmetrical poi's flexible long strap 75 is striking the juggler's arm 76, (illustrated here as cutting through the arm), or any other part of the juggler's body, and starts to band around it. In position 710 the second symmetrical poi's weights 76 is caught and held by the juggler's palm 74, and the rotation is continued.

FIG. 7*d* is a schematic illustration of another possible symmetrical poi's juggler's moves, the under-the-leg move. The under-the-leg move starts with position 711. Juggler 70 holds one of the symmetrical poi's weights 72 by one hand 73 and rotates the symmetrical poi 71. As shown in position 712, the symmetrical poi 71 is thrown beneath one of the juggler's legs 76. In position 713 the juggler 70 is catching one of the symmetrical poi's weights 72.

FIG. 7*e* is a schematic illustration of another possible symmetrical poi's juggler's moves, the like-a-stick move. As illustrated in FIG. 7*a*, juggler 70 holds one of the symmetrical poi's weights 72 by one hands 73 and rotates the symmetrical poi 71 in a vertical plane. The like-a-stick move starts with position 714 as the juggler 70 slides his palm 74 along the symmetrical poi's flexible long strap 75 towards the symmetrical poi's center 77 and continues the symmetrical poi's 71 rotation, similarly to rotating a rigid stick.

FIG. 7*f* is a schematic illustration of another possible symmetrical poi juggler's moves, the-two-jugglers-with-three-poi-move. The two-jugglers-with-three-poi move starts with position 715. Juggler 70 is rotating one symmetrical poi 78, at the same time near by juggler 80, is rotating one symmetrical poi 88 with one of his hands and another symmetrical poi 89, with his other hand. In position 716 juggler 80 releases the symmetrical poi 88 which moves in rotational movement toward juggler 70. In position 717 juggler 70, catches the symmetrical poi 88, by sits weight 72. After that juggler 70 rotates one symmetrical poi 78 by one of his hands and another symmetrical poi 88 by his other hand and juggler 80 rotates one symmetrical poi 89.

FIG. 7*g* is a schematic illustration of another possible symmetrical poi juggler's moves, the butterfly-hand-switching move. The butterfly-hand-switching move starts with position 718 as juggler 80 is rotating a first symmetrical poi 88 held in one hand 90 in one direction and at the same time juggler 80 is rotating a second symmetrical poi 89 in the other hand 91 in the opposite direction. In position 719 juggler 80 switches holding, now symmetrical poi 88 is held and rotated by the second hand 91 and the second symmetrical poi 89 is held and rotated by the first hand 90. If symmetrical poi 89 and symmetrical poi 88 look the same the visual effect of the move is an illusion of rotational directions changes of symmetrical poi 89 and symmetrical poi 88, and looks like the fluttering wings of a butterfly. This move can be done with two poi and is brought here as an example for a move that can be performed better when using two symmetrical poi.

FIG. 7*h* is a schematic illustration of another possible symmetrical poi juggler's moves, the butterfly-switch-throw move. The butterfly-switch-throw move starts with position 720 as juggler 80 is rotating one symmetrical poi 88 held by one hand 90 at a direction such that when the symmetrical poi's other weight 92 that is not held by the juggler's first hand 90 is drawn away from juggler 80 with upwards motion and at the same time juggler 80 is rotating another symmetrical poi 89 held by his other hand 91 in the opposite direction. In position 721 the juggler 80 releases the first symmetrical poi 88. In position 722 the juggler 80 switches the holding of the second symmetrical poi 89 from the second hand 91 to the first hand 90. In position 723 the first symmetrical poi 88 is caught by the juggler 80 with the other hand 91. This move also looks like the fluttering wings of a butterfly.

FIG. 7*i* is a schematic illustration of another possible symmetrical poi juggler's moves, the parallel-and-throw move. The parallel-and-throw move starts with position 724, as juggler 80 rotates one symmetrical poi 88 held in one hand 90 in a certain direction and at the same time juggler 80 rotates a second symmetrical poi 89 held by his second hand 91, at the same direction. In position 725 juggler 80 releases the first symmetrical poi 88. In position 726 juggler 80 switches the holding of the second symmetrical poi 89 from the second hand 91 to the first hand 90. In position 727 juggler 80 catches the first symmetrical poi 88 by his second hand 91.

An additional move is the big-stick move. This move is similar to the like a stick move but here the juggler rotates two symmetrical poi, instead of one, with one of his hands.

An additional move is the X-and-throw move. The X move is a basic move in poi performance art. In the X move two poi are rotated by one juggler in vertical planes such that when one poi is at the lowest point of the circle of motion the other poi is at the highest point of the circle of motion. At a certain time the poi that are at a low point is thrown above the other poi and later that poi is caught and the X move is continued. An improvement of the X move includes creating the illusion of moving the poi beneath one of the juggler's legs. Using symmetrical poi enables actual moving of the symmetrical poi beneath one of the juggler's legs a short time before the throwing. This move is referred to as the X-and-throw move.

An additional move is the butterfly-arm-roll. In this move the juggler rotates two symmetrical poi in horizontal planes in opposite directions. To prevent a collision of both symmetrical poi, one of the juggler's hands is located at a point that is before and below that of the other hand. With each revolution of the symmetrical poi the juggler switches the holding of both symmetrical poi. The juggler performs an arm roll move on the arm that is far from his body, and with continuous movement the juggler performs a palm roll move until catching the symmetrical poi.

An additional move is the back-to-front move. The move starts with throwing of a symmetrical poi upward behind the juggler's back and catching it in front of the juggler's body. Another version of the move is throwing the symmetrical poi from a point in front of the juggler's body and catching it at a point behind the juggler's back.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. In particular, the present invention is not limited in any way to the moves and maneuvers described.

What is claimed is:

1. A symmetrical poi, for enabling the performance of safe juggling moves such as moves around a juggler's body or around a part of a juggler's body, or close to a juggler's body, or by throwing into the air, or throwing into the air and catching, by one juggler or by more than one juggler, the symmetrical poi comprising:

(a) a flexible long strap, wherein the dynamic friction coefficient between said flexible long strap and the skin of said juggler is at least 0.4, and wherein the length of said flexible long strap is at least 40 centimeters and is at most 120 centimeters;

(b) a first weight disposed at one end of said flexible long strap, said first weight having a reversibly deformable soft structure and having dimensions that fit in a human hand for easy grasping, easy releasing and easy catching, having a cross-section that is substantially identical to the cross-section of said flexible long strap in the contact area with said flexible long strap, and wherein said first weight has cross-section areas that change gradually, forming a tangential three dimensional shape with said flexible long strap; and (c) a second weight disposed at the second end of said flexible long strap having a substantially identical mass to said first weight, having a reversibly deformable soft structure having dimensions that fit in a human hand for easy grasping, easy releasing and easy catching.

2. The symmetrical poi of claim 1, wherein the width of said first weight at its widest part is at least 30 millimeters and is at most 80 millimeters, and wherein the width of said first weight at its widest part is at least 1.3 times larger, and at most 2.2 times larger then the dimension of said flexible long strap at its widest part.

3. The symmetrical poi of claim 1, wherein each of said first weight and said second weight includes:

(i) a bag; and (ii) grains filling said bag;

Wherein in case of any collision of said first weight with said second weight would be a plastic collision and wherein said symmetrical poi can be grasped by pinching said weight between two fingers.

4. The symmetrical poi of claim 3, wherein said grain filling type is selected from a group consisting of rice grains, wheat grains, sorghum grains, and cotton grains or a combination of two or more types of grains.

5. The symmetrical poi of claim 3 wherein each of said a first weight and a said second weight have holes Wherein the size and shape of said hole is suitable for performance of rotation of said symmetrical poi around a finger stuck in said hole; and wherein said hole does not subtract from the sense of continuity of a closed hand sliding over said symmetrical poi.

6. The symmetrical poi of claim 1, wherein each of said first weight and said second weight includes:

(i) a bag; and (ii) weight filling said bag, wherein said weight filling type is selected from a group consisting of liquid or powder.

7. The symmetrical poi of claim 1 further comprising:

(d) means for increasing the visual effect of the performance.

8. The symmetrical poi of claim 7 wherein said means for increasing the visual effect is selected from a group consisting of decoration strips, phosphorous glowing paint, light sources, flashlights, fire torches, powder dispersals, or smoke dispersals.

9. The symmetrical poi of claim 8 wherein said light source for increasing the visual effect, emits colored light in which said light color is dependent on said symmetrical poi's rotational direction.

10. The symmetrical poi of claim 1 further comprising:

(e) means for increasing the sound effect of the performance.

11. The symmetrical poi of claim 1 wherein said first weight has a mass at least ten times larger than said flexible long strap's mass.

12. The symmetrical poi of claim 1 wherein each of said a first weight and a said second weight have a shape that conforms to a human hand.

13. A method for enabling a juggler to perform symmetrical poi's jugglers moves, the method comprising the steps of:

(a) providing the juggler with a symmetrical poi, said symmetrical poi including:

(i) a flexible long strap, wherein the dynamic friction coefficient between said flexible long strap and the skin of said juggler is at least 0.4, and wherein the length of said flexible long strap is at least 40 centimeters and is at most 120 centimeters;

(ii) a first weight disposed at one end of said flexible long strap, said first weight having a reversibly deformable soft structure and having dimensions that fit in a human hand for easy grasping, easy releasing and easy catching, having a cross-section that is substantially identical to the cross-section of said flexible long strap in the contact area with said flexible long strap, and wherein said first weight has cross-section areas that change gradually, forming a tangential three dimensional shape with said flexible long strap; and (iii) a second weight disposed at the second end of said flexible long strap having a substantially identical mass to said first weight, having a reversibly deformable soft structure having dimensions that fit in a human hand for easy grasping, easy releasing and easy catching; and (b) performing symmetrical poi juggler's move.

14. The method of claim 13 wherein said move is the throwing-and-catching move.

15. The method of claim 13 wherein said move is the palm-roll move.

16. The method of claim 13 wherein said move is the under-the-leg move.

17. The method of claim 13 wherein said move is the like-a-stick move.

18. The method of claim 13 wherein said move is the two-jugglers-with-three-poi move.

19. The method of claim 13 wherein said move is the butterfly-hand-switching move.

20. The method of claim 13 wherein said move is the butterfly-switch-throw move.

21. The method of claim 13 wherein the move is the parallel-and-throw move.

* * * * *